United States Patent [19]

Plough et al.

[11] 4,301,898

[45] Nov. 24, 1981

[54] PEACE OFFICER'S EQUIPMENT BAG

[76] Inventors: Stephan E. Plough, 15805 Oak Valley Rd.; David L. Swartzendruber, P.O. Box 1176, both of Ramona, Calif. 92065

[21] Appl. No.: 184,854

[22] Filed: Sep. 8, 1980

[51] Int. Cl.[3] ..... A45C 11/00

[52] U.S. Cl. ..... 190/52; 190/60; 150/34

[58] Field of Search ..... 190/60, 42, 52, 51; 150/35, 34

[56] References Cited

U.S. PATENT DOCUMENTS

| | | | |
|---|---|---|---|
| 676,310 | 6/1901 | Goldberg | 190/60 |
| 1,129,485 | 2/1915 | Harman | 150/34 |
| 2,631,632 | 3/1953 | Leachman | 150/34 |
| 3,999,639 | 12/1976 | Walters | 190/60 |

*Primary Examiner*—Donald F. Norton

*Attorney, Agent, or Firm*—Henri J. A. Charmasson

[57] ABSTRACT

A specialized equipment carrying bag designed expressly for use by police officers is preferably made of light-weight nylon or other synthetic fabric carried by a pair of looped carrying straps one of which nestles a billy club just over the junctures of the strap ends with the bag. Velcro retainer straps further secure the billy club, there also being several external compartments at least one of which is sealed with Velcro strips to hold handcuffs in such a way that they are easily accessible with one hand. Other pockets are provided on the outside of the bag for flashlights, ticket books and other pieces of equipment and accessories needed by peace officers, and on one end wall of the bag a number of the shells are conveniently retained by means of an elastic strap stitched to the bag at spaced intervals to define elastic convolutions to individually secure shotgun shells.

5 Claims, 7 Drawing Figures

FIG. 1
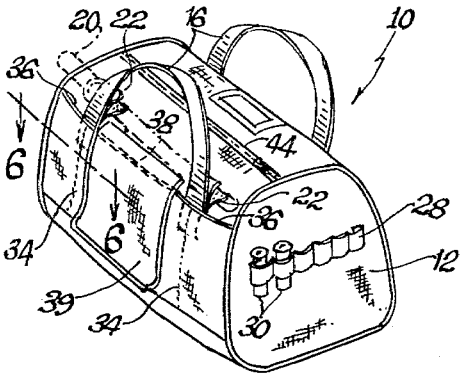
FIG. 2
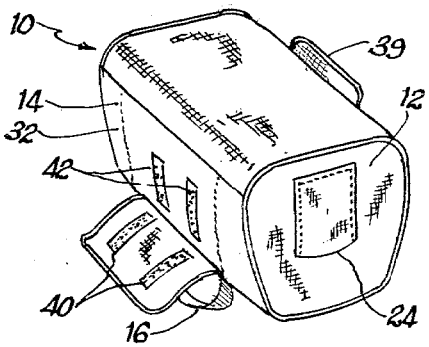
FIG. 3
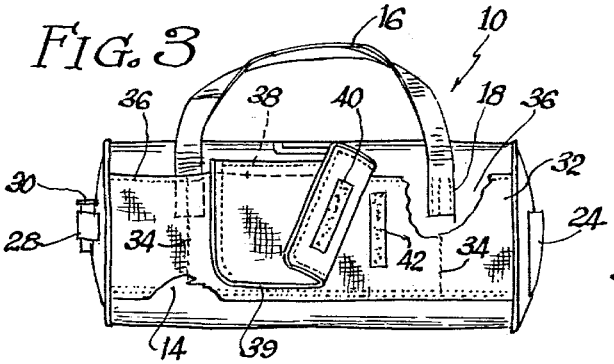
FIG. 4
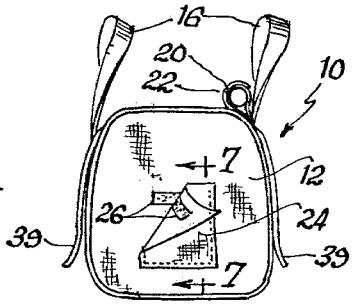
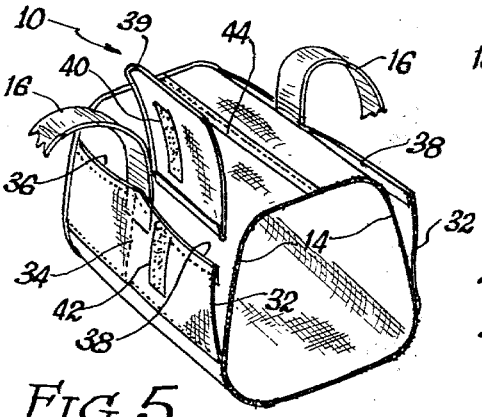
FIG. 5
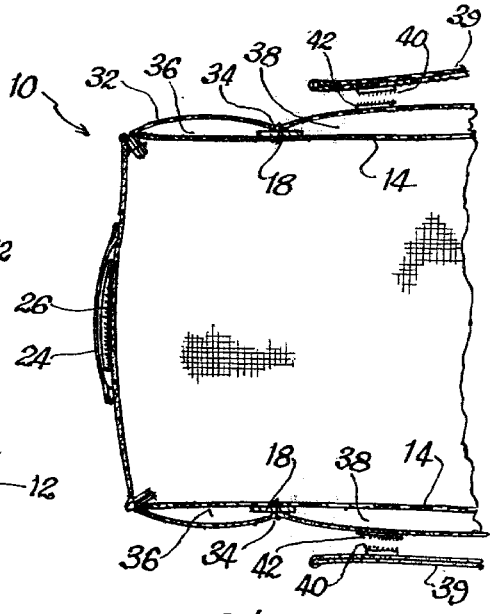
FIG. 6
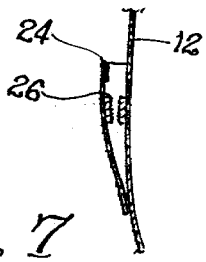
FIG. 7

PEACE OFFICER'S EQUIPMENT BAG

BACKGROUND

Peace officers ordinarily require a considerable amount of equipment and accessories when on patrol. Certain standard items are frequently needed, such as the peace officer's baton or "billy club", a pair of handcuffs, a helmet, shotgun shells, a flashlight and a ticket book. Heretofore peace officers have had to carry this equipment into the patrol car or to their motorcycle in duffle bags or gym bags not adapted specifically toward the needs of a peace officer. The result of carrying these accessories in general purpose carrying bags is to render some equipment which may be needed instantly rather inaccessible. For example, in the event an officer is patrolling alone and has an instance in which he must hold a flashlight or a gun in one hand and handcuff a suspect in the other, clearly he must have quick, one-handed access to the handcuffs for the procedure to be safe. This is not in keeping with having to shuffle through loose papers, shotgun shells, ticket books and other paraphernalia trying to locate the handcuffs, possibly in the dark bag.

SUMMARY

The present invention avoids the above-stated dilemma by providing a specifically designed equipment bag for a peace officer. The principal features of the bag are a pair of Velcro billy club retaining straps stitched between the ends of the carrying straps and the bag so that a billy club can be simply engaged by the Velcro straps and when the bag is carried, one of the carrying straps actually supports the billy club so that there is no danger of the Velcro jostling apart and the club coming loose. One end of the bag is provided with a scalloped, elastic shotgun shell cartridge holder for instant access to additional shotgun shells, which, in the event they are needed, obviously would be needed quickly. The other end of the bag has a quick-access pocket for handcuffs. This pocket has a Velcro closure making it easy for the officer to get to the handcuffs with only one hand.

There are further general purpose pockets defined by two cloth panels stitched to each side of the bag to define three open topped pockets, the stitching of these panels to the bag being done so as to reinforce the attachment of the carrying handles to the bag body.

BRIEF DESCRIPTION OF THE DRAWINGS

FIG. 1 is a perspective view of the bag;

FIG. 2 is a perspective view of the bag upside down;

FIG. 3 is a side elevation view of the bag with a pocket flap peeled back to reveal the Velcro strips;

FIG. 4 is an end elevation view of the bag showing the handcuff pocket;

FIG. 5 is a perspective view of the bag sectioned down the middle;

FIG. 6 is a sectional view of the bag taken along Line 6—6 of FIG. 1;

FIG. 7 is a section taken along Line 7—7 of FIG. 4.

DETAILED DESCRIPTION OF THE PREFERRED EMBODIMENTS

The bag of the instant invention has a central body portion or pouch 10 which is formed of tough but lightweight nylon cloth or similar synthetic fabric. The body defines two end walls 12 and two side walls 14 and is formed by stitching the end walls to a continuous length of cloth which defines the side walls, top and bottom of the bag.

On each side of the body 10 a carrying strap 16 is attached by stitching the ends at 18 so that loops defined by the straps extend over the bag and can be gripped together to define a handle. As shown in FIG. 4, one of the carrying straps also supports a baton or billy club 20 which is further secured by a pair of Velcro retaining straps 22. This double securing of the billy club prevents the jostling which it will experience during carrying from loosening the Velcro ties.

At one end of the bag a handcuff pocket 24 is defined which has a Velcro closure 26 to permit rapid, one-handed access to the handcuffs. The other end of the bag mounts an elastic strip 28 which defines consecutive convolutions which receive shotgun shells 30.

Side panels 32 are stitched into the seam joining the end walls 12 to the side walls 14 and along their bottom edges, and additionally are stitched vertically at 34. The stitching at 34 serves the double purpose of reinforcing the connection of the carrying straps to the body of the bag and also subdivides three open-topped pockets, two of them at 36 being the end pockets that are not provided with closures, and a central pocket 38 having a cover flap stitched to the body of the bag and a pair of Velcro fastener strips 40 which of course align with mating fastener material strips adhered to the outside of the panel at 42. These relatively thin, vertical, widely spaced Velcro strips securely hold the flap in place but are easily lifted with one hand by a quick outward tug on the lower edge.

The side pockets defined by the panels 32 can be used for miscellaneous equipment, such as the flashlight, ticket books, pencils, etc. The interior of the bag is dimensioned sufficiently large to accommodate a helmet and a jacket. These are the things a peace officer will not be required to extricate in a great hurry, and therefore are securely enclosed within the body of the bag which is provided with a zipper 44 along the top.

All external pockets however, as well as the shotgun shell holder, are specifically designed for quick, uncluttered, singlehanded access to accommodate the needs of a police officer on the beat and to eliminate the danger inherent in requiring the officer to fumble for handcuffs, shotgun shells and other paraphernalia required in his job.

I claim:

1. A peace officer's equipment bag comprising:

(a) an elongated flexible pouch having two side walls and two end walls;

(b) a pair of carrying straps each secured to said side wall by both ends and defining loops extendable over said pouch to permit grasping said loops as handles;

(c) a pair of Velcro retainer straps secured to said pouch just above the points of securement of one of said carrying straps, said retainer straps being sufficiently long to engage a police baton such that when said baton is so engaged and said straps are grasped for carrying said bag, said baton is supported at least in part by said one carrying strap; and (d) a pocket defined externally on one of said walls and having an open top with a Velcro closure for holding a pair of handcuffs for quick one-handed access.

2. Structure according to claim 1 and including a scalloped elastic strap externally stitched at spaced intervals to one of said walls to hold individually in the convolutions thereby defined a number of shotgun shells.

3. Structure according to claim 1 and including a pair of flexible panels extending along substantially the entire respective lengths of said side walls and being stitched to said side walls along their lower and side edges with vertical stitching aligned with said carrying strap ends to define three open-topped compartments on each of said side walls.

4. Structure according to claim 3 and including at least one closure flap for at least one of said compartments, said flap folding over the top of the respective compartment and being releasible fastened to the outside surface thereof by a pair of vertical rows of Velcro fasteners along the edges to permit quick one-handed access to said respective compartment by lifting the distal edge of said flap.

5. Structure according to claim 4 wherein the central compartment of each of said three open-topped containers has a cover flap, and the remaining open-topped containers are coverless for quick one-handed access.

* * * * *